US010161368B1

(12) United States Patent
Koplitz et al.

(10) Patent No.: US 10,161,368 B1
(45) Date of Patent: Dec. 25, 2018

(54) OUTBOARD MOTOR POWERHEAD SECTION AND FUEL DELIVERY SYSTEM HAVING LOW-PROFILE FUEL RAIL

(71) Applicant: Brunswick Corporation, Lake Forest, IL (US)

(72) Inventors: Wesley D. Koplitz, Oshkosh, WI (US); Jody A. Peterson, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 176 days.

(21) Appl. No.: 15/212,425

(22) Filed: Jul. 18, 2016

(51) Int. Cl.

| | |
|---|---|
| ***F02M 61/00*** | (2006.01) |
| ***F02M 55/02*** | (2006.01) |
| ***F02B 61/04*** | (2006.01) |
| ***F02M 57/04*** | (2006.01) |
| ***F02M 61/18*** | (2006.01) |
| ***F02M 35/10*** | (2006.01) |
| ***F02M 35/104*** | (2006.01) |
| ***F02M 37/00*** | (2006.01) |
| ***F02F 1/42*** | (2006.01) |
| ***B63H 20/00*** | (2006.01) |
| *F02M 69/46* | (2006.01) |

(52) U.S. Cl.
CPC ..... *F02M 55/025* (2013.01); *B63H 20/00* (2013.01); *B63H 20/001* (2013.01); *F02B 61/045* (2013.01); *F02F 1/4235* (2013.01); *F02M 35/104* (2013.01); *F02M 35/10216* (2013.01); *F02M 37/0076* (2013.01); *F02M 57/04* (2013.01); *F02M 61/18* (2013.01); *F02M 69/465* (2013.01)

(58) Field of Classification Search
CPC ..... F02M 69/465; F02M 35/10216; F02M 35/104; F02M 55/025; F02M 37/0076; F02M 57/04; F02M 61/18; B63H 20/00; B63H 20/001; F02B 61/045; F02F 1/4235
USPC ..... 123/456, 468, 469, 470
See application file for complete search history.

(56) References Cited

U.S. PATENT DOCUMENTS

| | | | | |
|---|---|---|---|---|
| 4,702,202 | A | 10/1987 | Hensel et al. | |
| 5,070,844 | A | 12/1991 | Daly | |
| 5,197,435 | A | 3/1993 | Mazur et al. | |
| 5,785,022 | A | 7/1998 | Haboush, II et al. | |
| 5,894,831 | A * | 4/1999 | Takahashi | F02B 61/045 123/195 P |

(Continued)

*Primary Examiner* — Hai Huynh
*Assistant Examiner* — Gonzalo Laguarda
(74) *Attorney, Agent, or Firm* — Andrus Intellectual Property Law, LLP

(57) ABSTRACT

An outboard motor powerhead section includes an engine having vertically stacked cylinders. The engine includes intake passages extending through the cylinder head to the cylinders. A fuel rail extends along a vertical center axis alongside the cylinder head. Receiver cups are coupled to the fuel rail and vertically spaced from one another such that each receiver cup is associated with a respective cylinder. Each receiver cup has a respective connector passage providing fluid communication between the fuel rail and receiver cup. Fuel injectors are respectively coupled to the receiver cups. Each fuel injector has an inlet end located in a respective receiver cup and extends along a center axis toward a nozzle end that extends into a respective intake passage. A cowl covers the engine. The vertical center axis of the fuel rail is located relatively more inboard with respect to the engine than is at least one connector passage.

16 Claims, 7 Drawing Sheets

(56) References Cited

U.S. PATENT DOCUMENTS

| | | | | |
|---|---|---|---|---|
| 5,957,112 | A | 9/1999 | Takahashi et al. | |
| 5,979,414 | A | 11/1999 | Pugh | |
| 6,030,262 | A | 2/2000 | Okamoto et al. | |
| 6,161,527 | A | 12/2000 | Ruman | |
| 6,672,287 | B2 * | 1/2004 | Wada | F02B 61/045 123/456 |
| 6,843,234 | B1 * | 1/2005 | de Vulpillieres | F02M 35/10216 123/456 |

* cited by examiner

OUTBOARD MOTOR POWERHEAD SECTION AND FUEL DELIVERY SYSTEM HAVING LOW-PROFILE FUEL RAIL

FIELD

The present disclosure relates to fuel delivery systems for outboard motor internal combustion engines.

BACKGROUND

U.S. Pat. No. 4,702,202 discloses a two cycle internal combustion engine having a fuel injection system with a low profile compact intake manifold mounted to the crankcase by an adaptor plate and defining an intake air flow path in a first direction behind the manifold through a gap between the manifold and the crankcase provided by the adaptor plate. Intake air then flows into throttle bore passages from behind the manifold and then reverses direction and flows through supply passages having fuel injectors and then into the crankcase. The passages share a common plenum within the manifold. The fuel injectors, their electrical connectors and a common rigid fuel supply rail are all in the common plenum entirely within the low profile manifold and sealed from moisture and salt in a marine environment.

U.S. Pat. No. 5,070,844 discloses an injector that is mechanically retained in a molded composite socket member by an annular cap that is threaded onto the end of the socket member containing the end of the through-bore into which the injector was inserted. The sidewall of the cap contains an internal helical thread that threads to an external helical thread on the exterior of the socket member. The cap stiffens the socket wall at the thread to strengthen the socket wall against circumferential expansion caused by the pressure of fuel in an annular space that surrounds the injector interior of the socket through-bore. A method for making the cap and joining it to the socket member is also disclosed.

U.S. Pat. No. 5,197,435 discloses an injection molded fuel injection rail for an automotive engine. The fuel rail is designed to supply fuel to a plurality of electromagnetic fuel injectors oriented at acute angles relative to vertical. The socket inlet apertures through which fuel is fed from the rail interior into the respective fuel injector sockets are located in the bottom of the rail. This prevents the ingestion of vapor, which is normally present in the upper portion of the rail, into the injectors. In order to maintain both sides of these socket inlet apertures at substantially the same level, the tilted injector sockets are provided with an occlusive lip along the high side of each inlet aperture. Additionally, the tilted socket axes may be offset laterally downward from the longitudinal rail axis. A plug type fitment is used to close the barrel core pin opening at one end of the rail. It is retained in the opening by a zero compressive load retainer which engages a cooperating annular shoulder structure formed on that end of the rail. To insure uniform distribution of the plastic injected into the mold and to prevent relative movement of the core pins by the force of the injected plastic during the molding process, a sprue site is located above each fuel injector socket in offset parallel alignment with the socket axis.

U.S. Pat. No. 5,785,022 discloses a fuel injector post for connecting a fuel injector to a fuel rail. The fuel injector post comprises a tubular body portion with a central axis having a circumferential wall, an open end and an outlet on the tubular body portion. The fuel injector post further comprises an adapter portion positioned at an angle to the central axis of the tubular body and integral with the outlet on the tubular body portion. The adapter portion has a passage in fluid communication with the tubular body portion and the fuel rail and therefore connects a fuel injector to the side of a fuel rail, which is advantageous to the engine package. Alternatively, the tubular body portion can have a closed end configured and adapted to reduce air entrapment in the tubular body portion to therefore reduce or eliminate pressure waves in the entire fuel system due to entrapped air.

U.S. Pat. No. 6,161,527 discloses a fuel injection system that incorporates a plurality of fuel injection arrangements, wherein each fuel injection is associated with a particular cylinder of the engine. Each of the fuel injection arrangements comprises a fluid passageway in which fuel and air are combined prior to injection into a combustion chamber of the cylinder. A valve is moveable with respect to an injection port to allow the pressurized fuel/air mixture to flow from the fluid passageway into the combustion chamber. A fuel injector is used to inject liquid fuel into the fluid passageway to be combined with pressurized air within the passageway. The system has a common air rail and a common fuel rail which are each connected to a plurality of the fuel injection arrangements. Upward movement of a piston within a cylinder is used to pressurize the air within the common air rail. All of the fuel injection arrangements can be used to contribute pressurized air to the common air rail.

SUMMARY

This Summary is provided to introduce a selection of concepts that are further described herein below in the Detailed Description. This Summary is not intended to identify key or essential features from the claimed subject matter, nor is it intended to be used as an aid in limiting the scope of the claimed subject matter.

According to one example of the present disclosure, an outboard motor powerhead section includes an internal combustion engine having a cylinder head coupled to a first end of a cylinder block. The cylinder block and the cylinder head together define vertically stacked cylinders. The engine also includes intake passages, each of which extends through the cylinder head to a respective cylinder. A fuel rail extends along a vertical center axis alongside the cylinder head. Receiver cups are coupled to the fuel rail and vertically spaced from one another such that each receiver cup is associated with a respective cylinder. Each receiver cup has a respective connector passage providing fluid communication between the fuel rail and the receiver cup. Fuel injectors are respectively coupled to the receiver cups. Each fuel injector has an inlet end located in a respective receiver cup and extends along a center axis toward a nozzle end that extends into a respective intake passage. A cowl covers the engine. The vertical center axis of the fuel rail is located relatively more inboard with respect to the engine than is at least one connector passage.

According to another example of the present disclosure, a fuel delivery system for an outboard motor internal combustion engine having a cylinder head coupled to a cylinder block is provided. The cylinder block and the cylinder head together define stacked cylinders. The engine includes intake passages, each intake passage extending through the cylinder head to a respective cylinder. The fuel delivery system includes a fuel source and a fuel pump in fluid communication with the fuel source. A fuel rail is in fluid communication with the fuel pump and extends along a center axis in a first direction alongside the cylinder head. Receiver cups are coupled to the fuel rail and spaced from one another in the first direction such that each receiver cup is associated with a respective cylinder. Each receiver cup has a connector passage that extends along a center axis in a second, different direction and into the fuel rail. Fuel injectors are respectively coupled to the receiver cups, each fuel injector having an inlet end located in a respective receiver cup and extending along a center axis in a third direction toward a nozzle end communicating with a respective intake passage. Each receiver cup comprises a tubular body portion having an open end for receiving the respective fuel injector and an opposite, closed end including a port communicating with the respective connector passage. The center axis of each fuel injector is oriented at an angle of less than 180 degrees with respect to a respective center axis of the port in the body portion of each receiver cup. The center axis of the fuel rail does not intersect with the center axes of the ports in the body portions of the receiver cups.

According to another example of the present disclosure, a fuel delivery system for an outboard motor internal combustion engine having a cylinder head coupled to a cylinder block, the cylinder block and the cylinder head together defining stacked cylinders, and having intake passages, each intake passage extending through the cylinder head to a respective cylinder, includes a fuel source and a fuel pump in fluid communication with the fuel source. A fuel rail is in fluid communication with the fuel pump and extends along a rail center axis alongside the cylinder head. Receiver cups are coupled to the fuel rail and spaced from one another with respect to the rail center axis such that each receiver cup is associated with a respective cylinder. Each receiver cup has a respective connector passage that extends into the fuel rail. Fuel injectors respectively coupled to the receiver cups, each fuel injector having an inlet end located in a respective receiver cup and extending along an injector center axis toward a nozzle end communicating with a respective intake passage. Each receiver cup includes a tubular body portion having an open end for receiving the respective fuel injector and an opposite, closed end including a port communicating with the respective connector passage. The rail center axis does not intersect with the injector center axes and does not intersect with respective port center axes of the ports in the body portions of the receiver cups.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
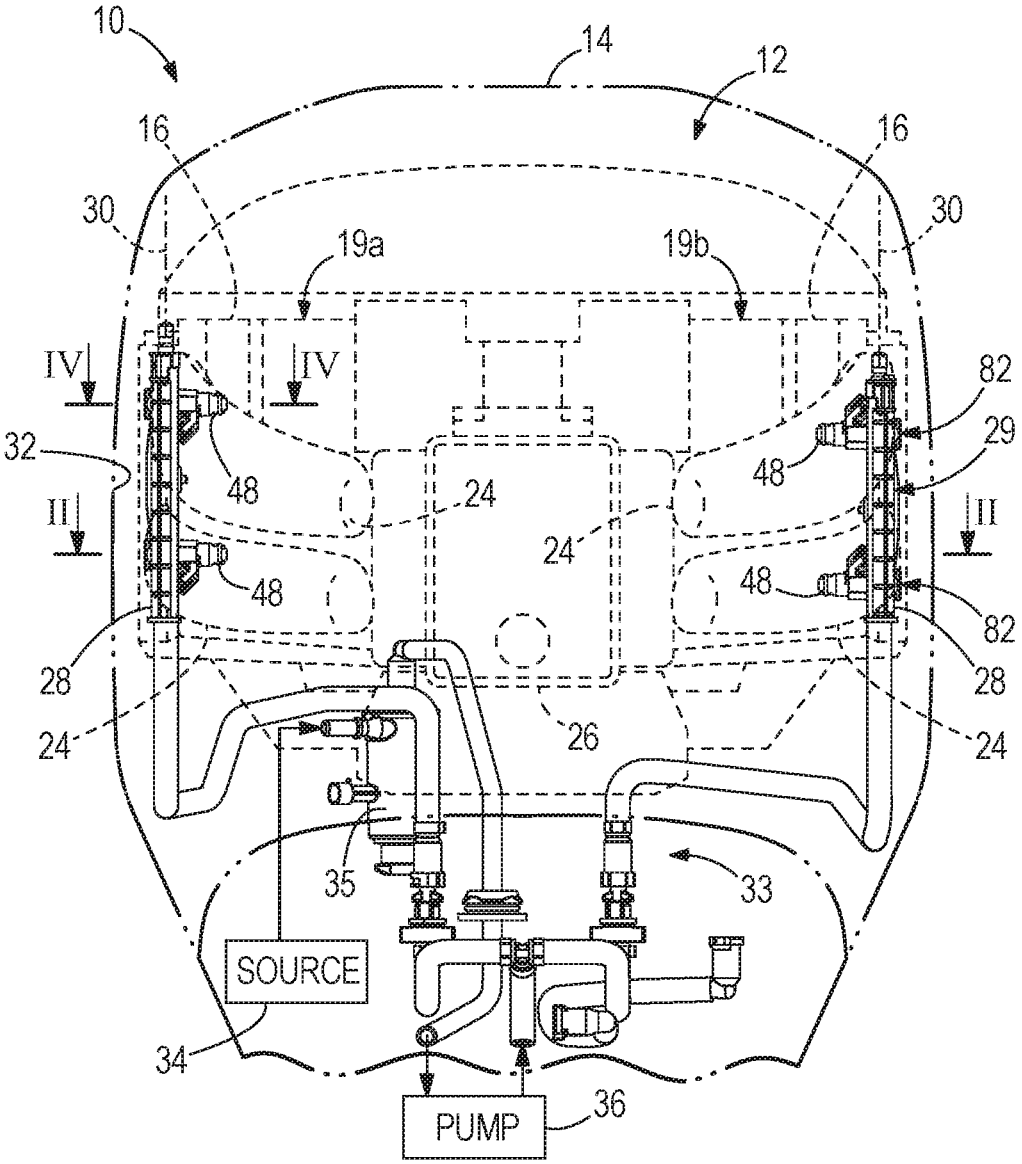
FIG. 1 illustrates a front view of a partially cross-sectioned outboard motor powerhead section according to the present disclosure, with an engine shown schematically in dashed lines and a fuel delivery system shown in solid lines.
Figure 2:
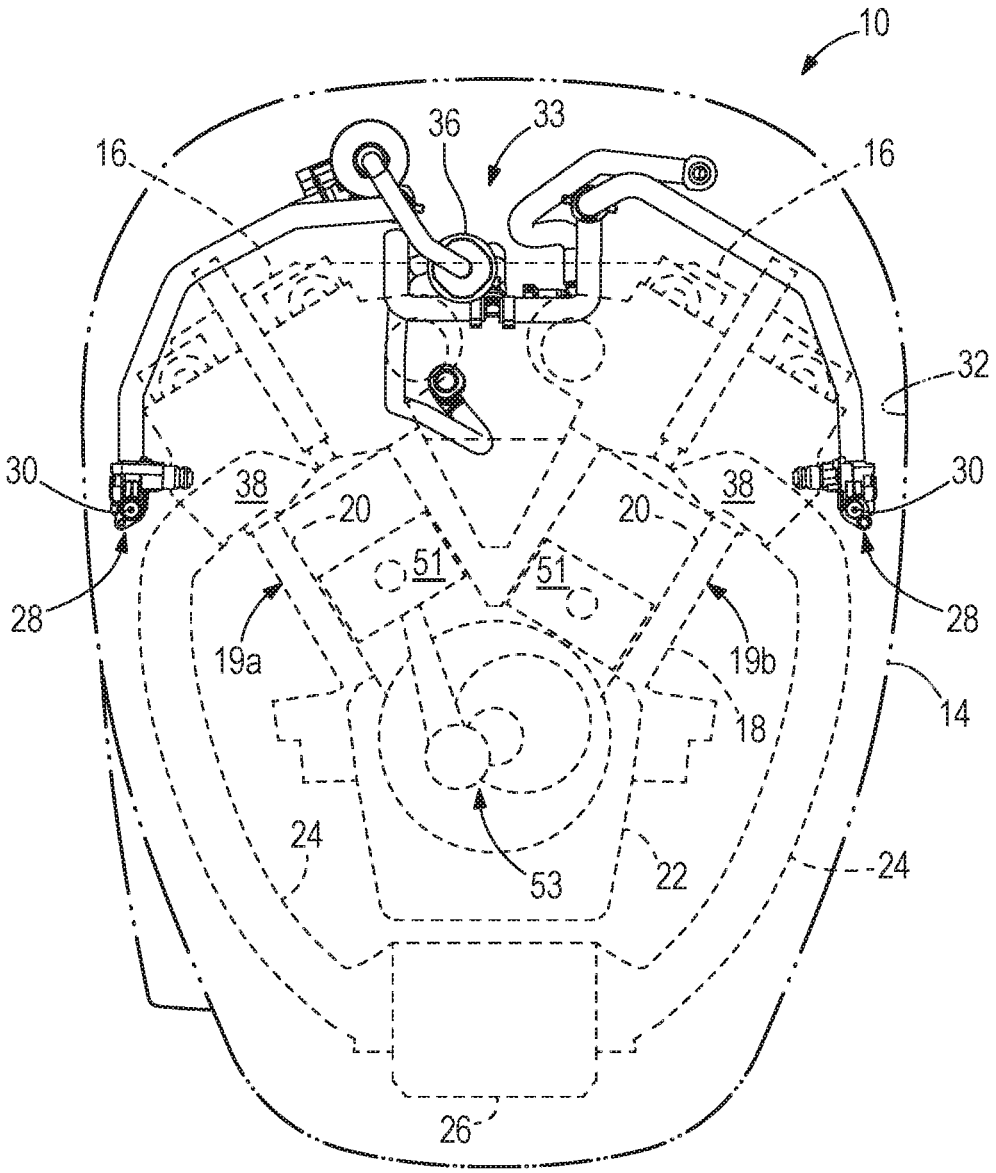
FIG. 2 illustrates a sectional view of the powerhead section, taken along the line II-II of FIG. 1.

FIG. 1 illustrates an outboard motor powerhead section 10 for an outboard motor including an internal combustion engine 12 covered by a cowl 14. Referring to each of FIGS. 1 and 2, the internal combustion engine 12 includes two cylinder heads 16 coupled to a first end of a cylinder block 18. The cylinder head 16 and cylinder block 18 together define a number of vertically stacked cylinders 20. Note that the cylinder block 18 shown herein has two banks 19*a*, 19*b* of two cylinders 20 each, which banks 19*a*, 19*b* are arranged in a V-shape. The engine 12 therefore is a V-4 engine. In other examples, the engine could be a V-2, V-6, V-8, or other type of engine. For example, the engine could be an in-line engine.

A crankcase cover 22 is coupled to a second, opposite end of the cylinder block 18 and encloses a vertically oriented crankshaft 53. Two pairs of intake runners 24 extend along either side of the cylinder block 18 from the crankcase cover 22 to a respective cylinder head 16. The intake runners 24 extend from a surge take or silencer 26 located fore of the crankcase cover 22 and around the outside of the cylinder banks 19*a*, 19*b*. One intake runner 24 is provided for each of the four cylinders 20. Thus, each intake runner 24 provides intake air to a respective intake passage 38, which intake passage 38 extends through the cylinder head 16 to a respective cylinder 20, as will be described further herein below. Two fuel rails 28 are provided to carry fuel to the intake passages 38 in the cylinder heads 16. Each fuel rail 28 extends along a respective vertical center axis 30 alongside each respective cylinder head 16. Each fuel rail 28 is located between a respective pair of intake runners 24 and an inner surface 32 of the cowl 14.

The fuel delivery system 33 for the engine 12 also includes a fuel source 34 that is in fluid communication with the fuel rails 28 by way of a fuel filter 35 and a fuel pump 36. This may be through a variety of different hoses, tubes, and the like. Additionally, a fuel reservoir, a high pressure pump, a low pressure pump, vapor separator, fuel supply module, and/or pressure sensors may be provided as part of the fuel delivery system 33 as known to those having ordinary skill in the art. Fuel return lines may also be provided to return fuel to the fuel source 34. The exact components and layout provided for the fuel source, reservoir, pump(s), etc. are ancillary to the details of the fuel delivery system 33 of the present disclosure, and are not limiting on the scope of the present claims. Briefly, in the example shown, the fuel pump 36 provides fuel at high pressure to each of the fuel rails 28, after which the flow of fuel is guided through receiver cups and fuel injectors of the fuel delivery system 33, as will be described below.

Figure 3:
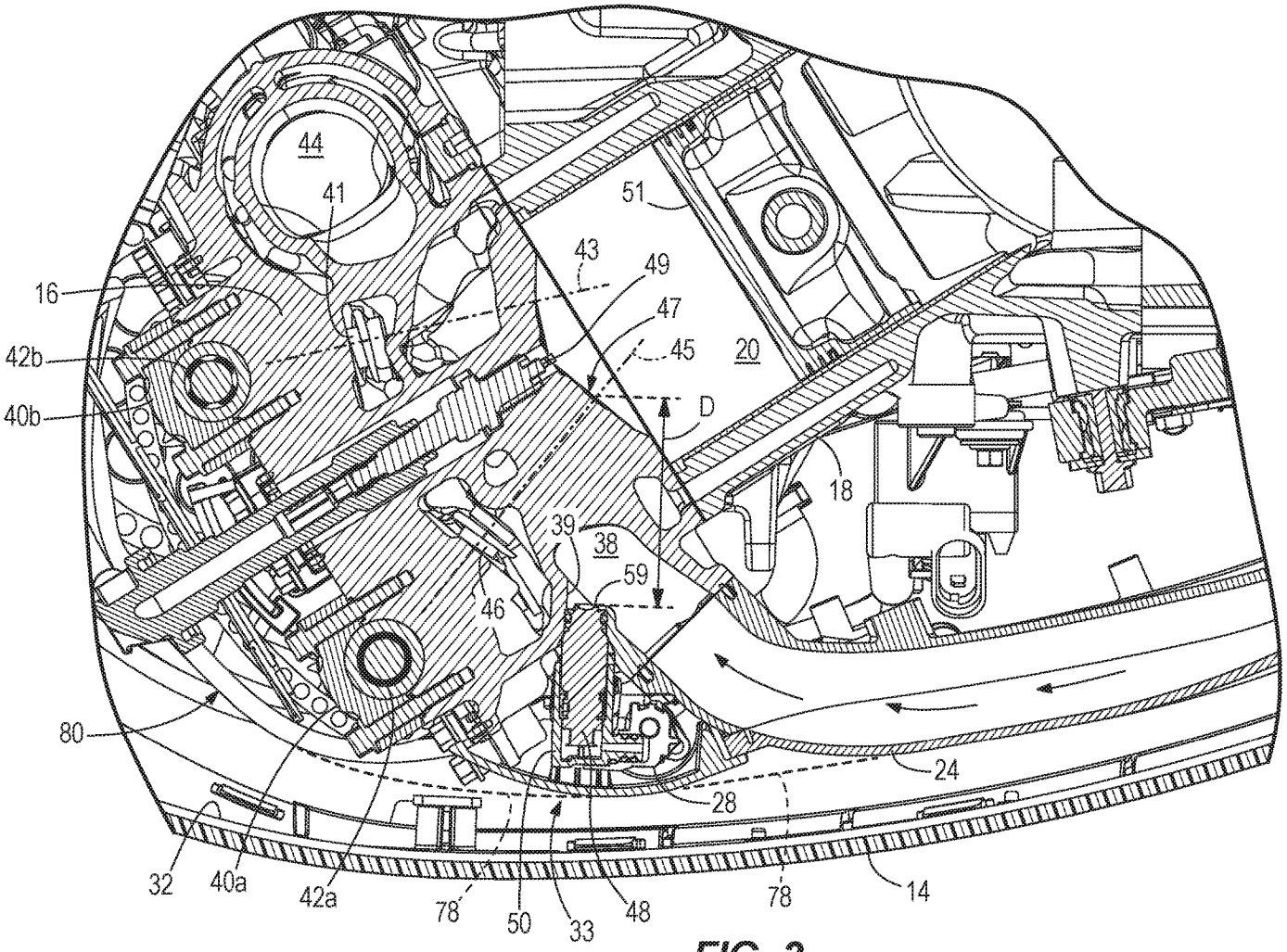
FIG. 3 illustrates a detailed view of portions of a cylinder head, a cylinder block, and a fuel delivery system according to the present disclosure.

As mentioned above, the engine 12 includes a plurality of intake passages 38, each intake passage 38 extending through a respective cylinder head 16 to a respective cylinder 20. One of the intake passages 38 is shown in more detail in FIG. 3, which shows a partial, cross-sectional view of the engine 12 at cylinder bank 19*a*. As shown in FIG. 3, cam covers 40*a*, 40*b* hold cam shafts 42*a*, 42*b* within the cylinder head 16. Cam shaft 42*a* opens and closes a spring-biased intake valve that provides selective communication between the cylinder 20 and intake passage 38. Cam shaft 42*b* opens and closes a spring-biased exhaust valve that provides selective communication between the cylinder 20 and exhaust passage 44. Although the intake valve between intake passage 38 and cylinder 20 cannot be fully seen in FIG. 3, a valve stem 46 that couples the intake valve to the cam shaft 42*a* is shown, which valve stem 46 extends along centerline 45. Additionally, the intake valve face 47 can be seen just at the opening where the intake passage 38 leads into the cylinder 20. Similarly, exhaust valve stem 41, extending along centerline 43, can be seen within cylinder head 16. A cylinder head cover 80 extends over the cam covers 40*a*, 40*b* and other cylinder head components.

Intake air travels through the intake runner 24 as shown by the direction of the arrows therein, enters the intake passage 38, and thereafter enters the cylinder 20 upon retraction of the intake valve face 47 from the opening that leads into the cylinder 20. Fuel is injected into the stream of air prior to its entry into cylinder 20 by a fuel injector 48, the coupling of which to fuel rail 28 will be described further herein below. Although only one intake passage 38 and fuel injector 48 are shown herein, it should be understood that the same assembly is provided at the cylinder above or below the one shown in FIG. 3, and that a mirror image of the assembly is provided in the opposite cylinder bank 19*b*. After the fuel-air mixture enters the cylinder 20, a spark plug 49 ignites the mixture, which upon combustion causes a piston 51 within the cylinder 20 to be pushed toward the crankshaft 53 (FIG. 2) of the engine 12. The pattern with which such combustion events take place is known to those having ordinary skill in the art, and in this example is a 4-stroke pattern, although engines that operate according to a 2-stroke pattern are contemplated within the scope of the present disclosure.

Figure 4:
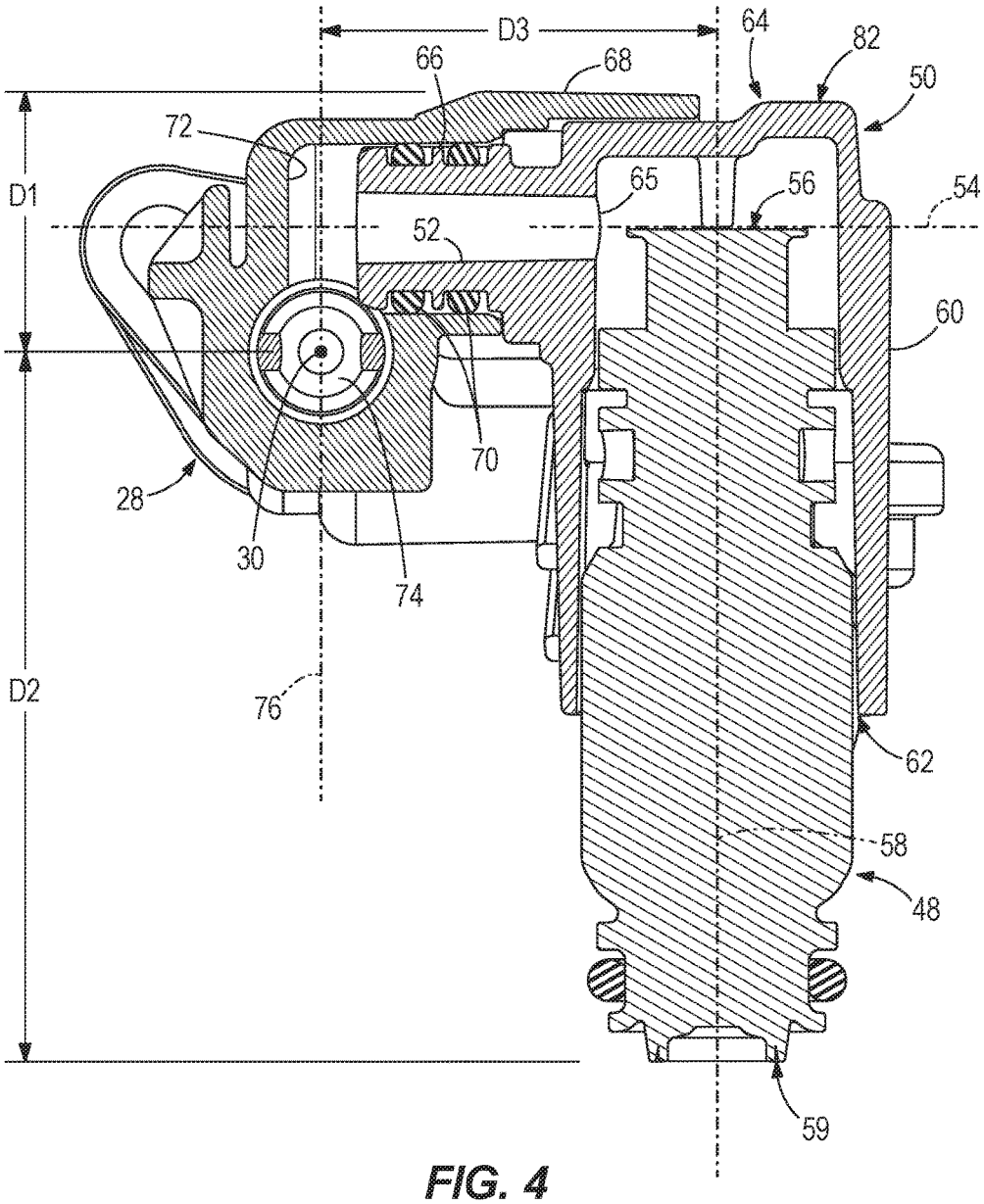
FIG. 4 illustrates a cross-sectional view of portions of the fuel delivery system according to the present disclosure, taken along the line IV-IV of FIG. 1.
Figure 5:
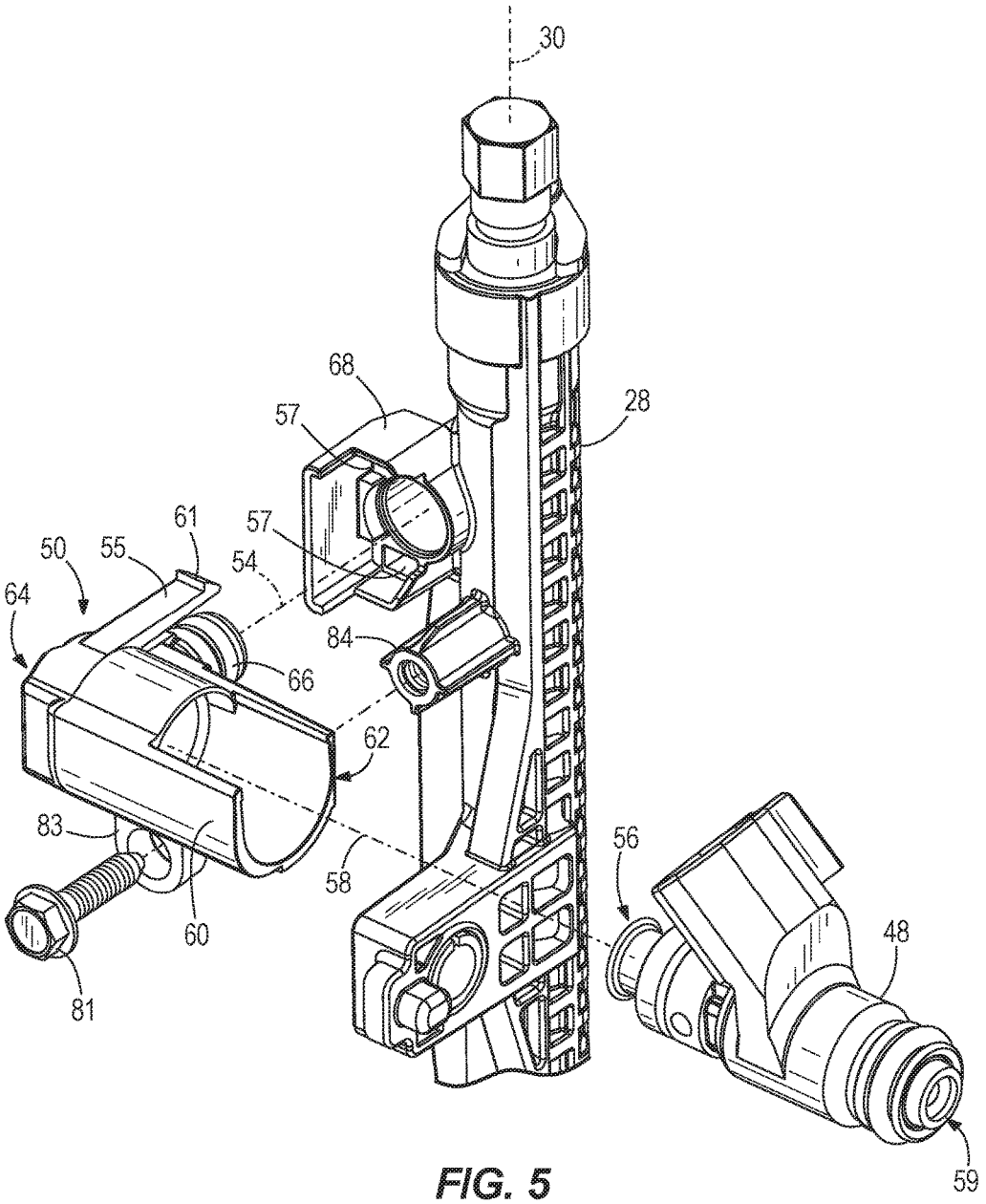
FIG. 5 illustrates a detailed, exploded view of portions of the fuel delivery system according to the present disclosure.

Referring to FIGS. 4 and 5, details regarding the coupling of the fuel injector 48 to the fuel rail 28 will be provided. Note that references to a component or an axis being horizontal or vertical are made with respect to the orientation of the powerhead section 10 when the outboard motor is mounted in a neutral (i.e., not trimmed or tilted) position on a marine vessel. In general, the portions of the fuel delivery system 33 that will now be described include the fuel rail 28, sockets 68 extending from the fuel rail 28, receiver cups 50 partially insertable within the sockets 68, and fuel injectors 48 partially insertable in the receiver cups 50. Each of these components will be described with respect to a single fuel injector assembly, which is the same for each cylinder 20 provided in the bank 19*a*, it being understood that a mirror image of the assembly is provided for each cylinder 20 in the other bank 19*b*.

As mentioned, the fuel delivery system 33 includes the plurality of receiver cups, one of which is shown at 50, coupled to the fuel rail 28 and vertically spaced from one another (see FIG. 1) such that each receiver cup 50 is associated with a respective cylinder 20. A shown, each receiver cup 50 is L-shaped and has a tubular adapter portion 66 oriented at an angle (here, 90 degrees) with respect to a tubular body portion 60. The tubular adapter portion 66 defines a connector passage 52 that extends along a horizontal center axis 54 into the fuel rail 28. The connector passage 52 provides fluid communication between the fuel rail 28 and the receiver cup 50 via a port 65, which shares a center axis 54 with the connector passage 52. A plurality of fuel injectors 48, only one of which is shown in FIGS. 4 and 5, are respectively coupled to the receiver cups 50. Each fuel injector has an inlet end 56 located in a respective receiver cup 50 and extends along a center axis 58 toward a nozzle end 59. The nozzle end 59 of each fuel injector 48 communicates with a respective intake passage 38 (FIG. 3) and thereby injects fuel into the intake passage 38 upstream of the intake valve. The nozzle end 59 of the fuel injector 48 may fully extend into the intake passage 38, or could instead be located in a side passage 39 within the cylinder head 16 that connects to the intake passage 38. In the example shown herein, a portion of the nozzle end 59 extends into the intake passage 38, while the remainder of the nozzle end 59 is located within the side passage 39.

The center axes 58 of each of the fuel injectors 48 are oriented at an angle of less than 180° with respect to the horizontal center axes 54 of the connector passages 52. In one example, the center axes 58 of the fuel injectors 48 are oriented at an angle of less than or approximately equal to 90° with respect to the horizontal center axes 54 of the connector passages 52. More specifically, in the example shown herein, the center axes 58 of the fuel injectors 48 are horizontal, and are perpendicular to the horizontal center axes 54 of the connector passages 52. Thus, the center axis 58 of each fuel injector 48 is also perpendicular to the respective center axis 54 of the port 65 in the body portion 60 of the receiver cup 50. Each receiver cup 50 includes the tubular body portion 60, which has an open end 62 for receiving the fuel injector 48 and an opposite, closed end 64 for receiving fuel from the connector passage 52. The closed end 64 also includes the port 65 communicating with the connector passage 52. Thus, for each receiver cup 50, the tubular adapter portion 66 is oriented at the angle of less than 180° (and in one example, is perpendicular) with respect to the body portion 60. The center axis 58 of each fuel injector 48 is thus also oriented at the angle of less than 180 degrees (and in one example, is perpendicular) with respect to the center axis 54 of the port 65 in the body portion 60 of the receiver cup 50. In the example shown, the tubular body portion 60 and the tubular adapter portion 66 are formed integrally with one another such that the connector passage 52 is integral with the receiver cup 50; however, the tubular body portion 60 and the tubular adapter portion 66 could instead be separate parts.

The fuel rail 28 includes a plurality of sockets 68 extending therefrom. Each socket 68 receives a respective adapter portion 66 of a respective receiver cup 50 therein. Thus, there is the same number of sockets 68 provided as there are cylinders 20 and fuel injectors 48. Each socket 68 in the plurality of sockets is integral with the fuel rail 28. An O-ring seal, including two or more O-rings 70, is provided between an outer surface of each respective adapter portion 66 and an inner circumference of a respective socket 68. For this purpose, the tubular adapter portion 66 may be provided with circumferential indentations, as shown herein, into which the O-rings 70 may fit, or the socket 68 may be provided with radially inwardly extending ledges for locating the O-rings therebetween. The innermost surface of the tubular socket 68 and the outermost surface of the tubular adapter portion 66 fit closely against one another, and the O-rings 70 prevent any leaks between the two. The receiver cup 50 can be snapped together with the socket 68 by way of locking tabs (an upper one of which is shown at 55) extending above and below the adapter portion 66. Locking tabs 55 fit into upper and lower tab receiver slots 57 situated in the upper and lower walls of the socket 68. Each locking tab 55 has a ramped protrusion 61 on its distal end, the ramping of which allows the locking tab 55 to slide into and through a respective receiver slot 57 with relative ease. When the protrusions 61 spring out of the opposite ends of the receiver slots 57, they act as positive stops that prevent the receiver cup 50 from falling out of the socket 68. After the adapter portion 66 has been inserted and locked into the socket 68, the receiver cup 50 may be further fastened to the fuel rail 28 by way of a fastener 81, which may extend through a tab 83 on the receiver cup 50 and into a fastener receiver 84 that protrudes from the side of the fuel rail 28. In other examples, these parts may be friction fit, adhered, or otherwise fastened to one another.

Each socket 68 includes a transition passage 72 that connects a central passage 74 of the fuel rail 28 to a respective connector passage 52 of a respective receiver cup 50. A center axis 76 of the transition passage 72 is oriented perpendicular to the center axis 30 of the fuel rail 28 and perpendicular to the center axis 54 of the connector passage 52. For example, referring to FIG. 4, the center axis 30 of the fuel rail 28 extends vertically, which here is into and out of the plane of the paper, and the center axis 76 of the transition passage 72 extends up and down with respect to the page, which is horizontal with respect to the powerhead section 10 when the outboard motor is in a neutral position. The center axis 54 of the connector passage 52 also extends perpendicular to the center axis 76, horizontally with respect to the plane of the page, and horizontally with respect to the powerhead section 10. The center axis 58 of the fuel injector 48 extends up and down with respect to the plane of the paper, and horizontally with respect to the powerhead section 10. In other examples, the center axis 58 of the fuel injector 48 is angled with respect to the powerhead section 10, i.e., tilted into or out of the plane of the page of FIG. 4.

Thus, the flow of fuel through the fuel delivery system 33 can be described as follows. Fuel flows from the fuel pump 36 through the central passage 74 of the fuel rail 28 in a first direction, next turns at a right angle to flow through each respective transition passage 72, next turns at a right angle to flow in a second direction through each respective connector passage 52, and next turns at an angle of less than 180 degrees to flow in a third direction through each respective fuel injector 48. More generally, fuel flows from the fuel pump 36 through the fuel rail 28 in the first direction, next turns at a right angle and flows in at least a second direction through each respective connector passage 52, and next turns at the angle of less than 180 degrees to flow in the third direction through each respective fuel injector 48. In one example, fuel flows away from the engine 12 after exiting the fuel rail 28 (such as through transition passage 72), and before flowing in the third direction toward the engine 12 (such as through fuel injector 48).

Fuel is then injected into the intake passage 38 with which the fuel injector 48 is associated and is thereafter sucked as part of a fuel-air mixture into the cylinder 20 upon opening of the intake valve. According to the present disclosure, the first direction (of the central passage 74 along center axis 30) is vertical. The second direction (of the connector passage 52 along center axis 54) is horizontal. The third direction (of center axis 58 of fuel injector 48) is also horizontal. Additionally, in the present example, each of the first, second, and third directions is perpendicular to the other of the first, second, and third directions. More generally, the first direction may be vertical and the second and third directions may be horizontal. The direction of center axis 76 of transition passage 72 may also be horizontal, and may be perpendicular to the center axis 30 of the fuel rail 28 and perpendicular to the axis 54 of the connector passage 52. In the example shown, the center axis 76 of the transition passage 72 is parallel to and offset from the center axis 58 of the fuel injector 48. In the present example, the rail center axis 30 does not intersect with the injector center axes 58 and does not intersect with respective port center axes 54 of the ports 65 in the body portions 60 of the receiver cups 50.

The layout of the components of the fuel delivery system 33 with respect to one another, coupled with the fact that the vertical center axis 30 of the fuel rail 28 does not intersect with the horizontal center axes 54 of the connector passages 52 (nor with the with the center axes of 54 the ports 65 in the body portions 60 of the receiver cups 50), ensures that the fuel delivery system 33 has a low profile and is tucked in closely to the engine 12. This means that the fuel rail 28 can be eliminated as a determining factor for how close the cowl 14 can be placed to an outer surface of the engine 12. For example, referring to FIG. 3, the vertical center axis 30 of the fuel rail 28 is further from the inner surface 32 of the cowl 14 than are the horizontal center axes 54 of the connector passages 52. Said another way, the center axis 30 of the fuel rail 28 is closer to the cylinder block 18 than are the center axes 54 of the connector passages 52 (or the center axes 54 of the ports 65), or the vertical center axis 30 of the fuel rail 28 is located relatively more inboard with respect to the engine 12 than is at least one connector passage 52. Thus, the fuel rail 28 is tucked in as close to the engine 12 as possible. In fact, referring briefly to FIG. 1, an outboard-most outer surface 29 of the fuel rail 28 is further from the inner surface 32 of the cowl 14 than are outboard-most outer ends/surfaces 82 of the receiver cups 50. This means that the outboard-most outer end (i.e., outer surface 82 of closed end 64) of each receiver cup 50 is further outboard with respect to the engine 12 than the center axis 54 of the port 65 in the body portion 60 of each receiver cup 50. See FIG. 4. Additionally, according to the present disclosure, the fuel rail 28, the receiver cups 50, and the fuel injectors 48 are located inboard of a filleted curve 78 that connects an outer extent (surface) of the intake runners 24 with an outer extent (surface) of the cylinder head cover 80 coupled to the cylinder head 16. See FIG. 3.

Some specific distances are included below in order to describe the relationship of the fuel delivery system components to the cylinder 20, cylinder head 16, and intake valve. For example, referring to FIG. 3, a distance D between a center of a face 47 of the intake valve and the nozzle end 59 of a respective fuel injector 48 may be specified. In one example, this distance D is between about 60 millimeters and about 80 millimeters. In another example, this distance D is about 70 millimeters. Referring to FIG. 4, a horizontal distance D1 between the vertical center axis 30 of the fuel rail 28 and an outer surface 82 (outboard-most outer end) of the closed end 64 of the body portion 60 of the receiver cup 50 is between about 13 millimeters and about 16 millimeters. In this example, D1 is about 14.5 millimeters. Additionally, a distance D2 between the center axis 30 of the fuel rail 28 and the nozzle end 59 of the fuel injector 48 may be between about 35 millimeters and about 45 millimeters. In this example, D2 is about 39.4 millimeters. In the example shown, the fuel injector 48 has no tip, which is unusual for outboard motor fuel system applications, but which allows the distance D2 to be minimized. The distance D1+D2 (i.e., overall length of the assembly) is also minimized by provision of the transition passage 72 in the fuel rail 28, which allows the inlet end 56 of the fuel injector 48 to be situated further from the body of the engine 12 than is the center axis 30 of the fuel rail 28. For instance, the inlet end 56 of the fuel injector 48 can be co-located with the center axis 54 of the connector passage 52 in the adapter portion 66 of the receiver cup 50, thereby allowing fuel to flow directly into the inlet end 56 of the fuel injector 48. This arrangement allows the electrical connector in the fuel injector 48 to be of the required length, while minimizing the overall length D1+D2 of the assembly. Additionally, a distance D3 between the center axis 30 of the fuel rail 28 and the center axis 58 of the fuel injector 48 may be between about 20 millimeters and about 25 millimeters, or more specifically about 22 millimeters. This tucks the fuel rail 28 in next to the fuel injector 48.

Thus, as a result of the specific geometry, components, and layout of the above-mentioned fuel delivery system 33, the problem of spatial integration of a fuel rail assembly including a fuel rail volume, fuel injectors, electrical connectors, and associating mounting hardware and interfaces, either into and/or between base engine components, peripheral components, and cowl components can be solved. While a given distance needs to remain between the nozzle end 59 of the fuel injector 48 and the face 47 of the intake valve in order to provide enough distance for the fuel to mix with the intake air before entering the cylinder 20, the distance D provided herein has been tested and proves to be sufficient for good fuel economy and acceptable emissions. Although the electrical connector within the fuel injector 48 provides a limiting factor on how compact the fuel delivery system can be, and although a certain spacing may need to be provided between the outer surface 82 of the closed end 64 of the receiver cup 50 and the inner surface 32 of the cowl 14, the present geometry and layout allow the fuel rail 28 and associated components to be tucked within a space between the intake runner 24 and the cylinder head cover 80 while meeting these requirements. A design in which the center axis 30 of the fuel rail 28 is closer to the cylinder block 18 than are the center axes 54 of the connector passages 52, and in which fuel navigates the 90° turns described herein above, can allow for the fuel rail 28 to be installed with a low profile with respect to the engine 12.

Figure 6:
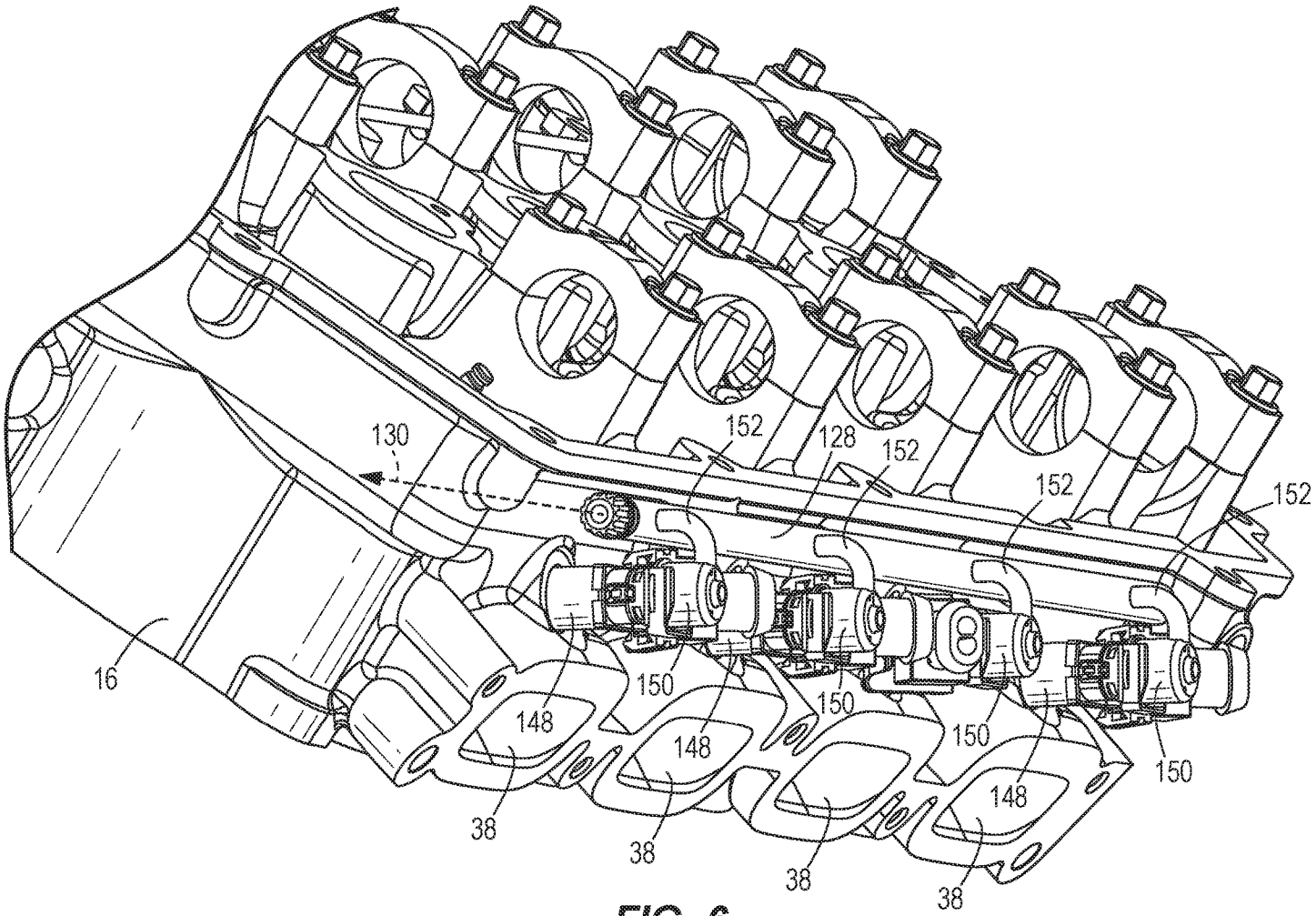
FIG. 6 illustrates a perspective view of an alternative embodiment of a portion of a fuel delivery system according to the present disclosure.

FIG. 6 shows an alternative embodiment of a portion of a fuel delivery system according to the present disclosure, including fuel rail 128. Receiver cups 150 are coupled to the fuel rail 128 and spaced from one another with respect to a rail center axis 130 such that each receiver cup 150 is associated with a respective cylinder (not shown). Each receiver cup 150 has a respective connector passage 152 that extends into the fuel rail 128. In this example, the connector passages 152 are individual feeder tubes that can be integral with or connected to the receiver cups 150. Fuel injectors 148 are respectively coupled to the receiver cups 150. In this example, the fuel rail 128 is provided between the cam area and the fuel injectors 148, rather than between the intake passages 38 (here, four intake passages 38 are provided) and the fuel injectors 148, but this orientation could be flipped.

Figure 7:
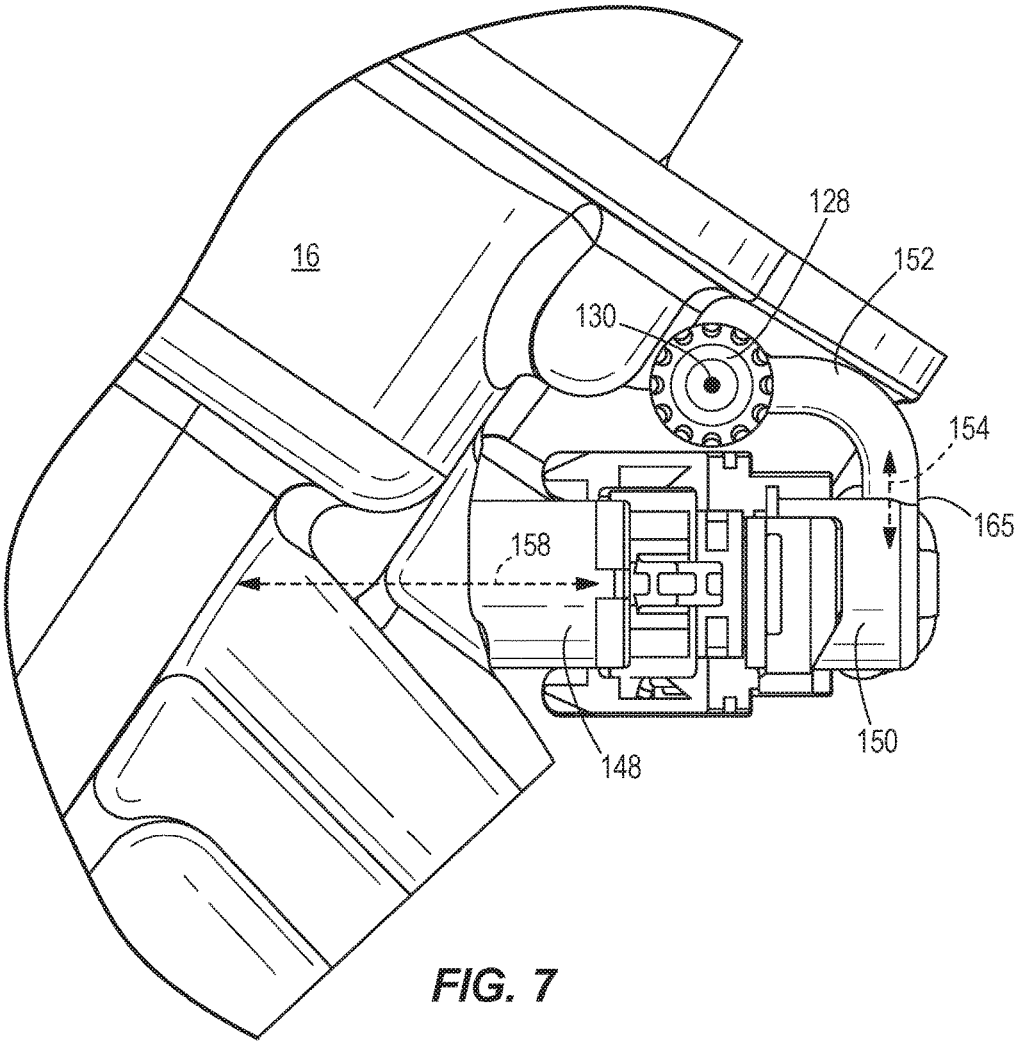
FIG. 7 illustrates a top view of the portion of the fuel delivery system of FIG. 6.

FIG. 7 shows a top view of the second embodiment of the assembly, including the location of the port 165 between the connector passage 152 and the receiver cup 150. Note that similar to the embodiment described herein above with respect to FIGS. 1-5, the rail center axis 130 does not intersect with the injector center axis 158. Nor does the rail center axis 130 intersect with the center axis 154 of the port 165. Here, although the center axis 154 of the port 165 is not the same as the center axis of the connector passage 152 due to the curvature of the connector passage 152, the perpendicularity of the port center axis 154 to both the rail center axis 130 and the injector center axis 158 remains, thus providing a direction-switching fuel flow path that allows for the fuel rail to be tucked in close to the engine 12. Other benefits of the first embodiment apply to the second embodiment as well, but will not be described further herein, as they are apparent from the configuration shown in FIGS. 6 and 7. For example, the center axis 158 of each fuel injector 148 is oriented at an angle of less than 180 degrees with respect to a respective center axis 154 of the port 165 in the body portion of each receiver cup 150. Additionally, the vertical center axis 130 of the fuel rail 128 is located relatively more inboard with respect to the engine than is at least one connector passage 152.

According to yet another example of the present disclosure, with reference back to FIGS. 3 and 4, an outboard motor powerhead section includes an internal combustion engine 12 having a cylinder head 16 coupled to a first end of the cylinder block 18. The cylinder block 18 and the cylinder head 16 together define vertically stacked cylinders 20. The internal combustion engine also includes intake passages 38, each intake passage extending through the cylinder head 16 to a respective cylinder 20. A fuel rail 28 extends along a vertical center axis 30 alongside the cylinder head 16. Receiver cups 50 are coupled to the fuel rail 28 and are vertically spaced from one another such that each receiver cup 50 is associated with a respective cylinder 20. Each receiver cup 50 has a connector passage 52 that extends along a horizontal center axis 54 into the fuel rail 28. Fuel injectors 48 are also provided, each fuel injector 48 having an inlet end 56 located in a respective receiver cup and extending along a center axis 58 toward a nozzle end 59 that extends into a respective intake passage. The center axes 58 of the fuel injectors 48 are orientated at an angle of less than 180° with respect to the horizontal center axes 54 of the connector passages 52. A cowl 14 covers the engine 12. The vertical center axis 30 of the fuel rail 28 does not intersect with the horizontal center axes 54 of the connector passages 52.

According to another example of the present disclosure, with reference now also to FIG. 1, a fuel delivery system for an outboard motor internal combustion engine 12 having a cylinder head 16 coupled to a cylinder block 18 is provided. The cylinder block 18 and the cylinder head 16 together define stacked cylinders 20. The engine 12 includes intake passages 38, each intake passage 38 extending through the cylinder head 16 to a respective cylinder 20. The fuel delivery system includes a fuel source 34 and a fuel pump 36 in fluid communication with the fuel source 34. A fuel rail 28 is in fluid communication with the fuel pump 36 and extends along a center axis 30 in a first direction alongside the cylinder head 16. Receiver cups 50 are coupled to the fuel rail 28 and spaced from one another in the first direction such that each receiver cup 50 is associated with a respective cylinder 20. Each receiver cup 50 has a connector passage 52 that extends along a center axis 54 in a second, different direction and into the fuel rail 28. Fuel injectors 48 are also provided, each fuel injector 48 having an inlet end 56 located in a respective receiver cup 50 and extending along a center axis 58 in a third direction toward a nozzle end 59 communicating with a respective intake passage 38. The center axes 58 of the fuel injectors 48 are oriented at an angle of less than 180° with respect to the center axes 54 of the connector passages 52. The center axis 30 of the fuel rail 28 does not intersect with the center axes 54 of the connector passages 52.

In the above description, certain terms have been used for brevity, clarity, and understanding. No unnecessary limitations are to be inferred therefrom beyond the requirement of the prior art because such terms are used for descriptive purposes and are intended to be broadly construed. The different systems described herein may be used alone or in combination with other systems. It is to be expected that various equivalents, alternatives and modifications are possible within the scope of the appended claims.

What is claimed is:

1. An outboard motor powerhead section comprising:

an internal combustion engine having a cylinder head coupled to a first end of a cylinder block, the cylinder block and the cylinder head together defining vertically stacked cylinders, and having intake passages, each intake passage extending through the cylinder head to a respective cylinder;

a crankcase cover coupled to a second, opposite end of the cylinder block;

intake runners that extend along a side of the cylinder block from the crankcase cover to the cylinder head, each intake runner providing intake air to a respective intake passage;

a fuel rail extending along a vertical center axis alongside the cylinder head;

receiver cups coupled to the fuel rail and vertically spaced from one another such that each receiver cup is associated with a respective cylinder, each receiver cup having a respective connector passage providing fluid communication between the fuel rail and the receiver cup;

fuel injectors respectively coupled to the receiver cups, each fuel injector having an inlet end located in a respective receiver cup and extending along a center axis toward a nozzle end that extends into a respective intake passage; and a cowl covering the engine;

wherein the vertical center axis of the fuel rail is located relatively more inboard with respect to the engine than is at least one connector passage; and wherein the fuel rail is located between the intake runners and a nearest inner surface of the cowl.

2. The powerhead section of claim 1, wherein an outboard-most outer surface of the fuel rail is further from the nearest inner surface of the cowl than are outboard-most outer ends of the receiver cups.

3. The powerhead section of claim 2, further comprising a cylinder head cover coupled to the cylinder head, wherein the fuel rail, the receiver cups, and the fuel injectors are located inboard of a filleted curve connecting an outer extent of the intake runners with an outer extent of the cylinder head cover.

4. The powerhead section of claim 2, wherein each receiver cup comprises a tubular body portion having an open end for receiving the respective fuel injector and an opposite, closed end including a port communicating with the respective connector passage.

5. The powerhead section of claim 4, wherein the center axis of each fuel injector is oriented at an angle of less than 180 degrees with respect to a respective center axis of the port in the body portion of each receiver cup.

6. The powerhead section of claim 5, wherein the center axis of each fuel injector is horizontal and is perpendicular to the respective center axis of the port in the body portion of each receiver cup.

7. The powerhead section of claim 6, wherein the outboard-most outer end of each receiver cup is further outboard than the center axis of the port in the body portion of each receiver cup.

8. The powerhead section of claim 7, wherein a horizontal distance between the vertical center axis of the fuel rail and the outboard-most outer end of each receiver cup is between about 13 millimeters and about 16 millimeters.

9. The powerhead section of claim 1, wherein each connector passage is integral with each respective receiver cup.

10. A fuel delivery system for an outboard motor internal combustion engine having a cylinder head coupled to a first end of a cylinder block, the cylinder block and the cylinder head together defining stacked cylinders, and having intake passages, each intake passage extending through the cylinder head to a respective cylinder, and having a crankcase cover coupled to a second, opposite end of the cylinder block, and having intake runners that extend along a side of the cylinder block from the crankcase cover to the cylinder head, each intake runner providing intake air to a respective intake passage, the fuel delivery system comprising:

a fuel rail extending along a rail center axis alongside the cylinder head;

receiver cups coupled to the fuel rail and spaced from one another with respect to the rail center axis such that each receiver cup is associated with a respective cylinder, each receiver cup having a respective connector passage that extends into the fuel rail; and fuel injectors respectively coupled to the receiver cups, each fuel injector having an inlet end located in a respective receiver cup and extending along an injector center axis toward a nozzle end communicating with a respective intake passage;

wherein each receiver cup includes a tubular body portion having an open end for receiving the respective fuel injector and an opposite, closed end including a port communicating with the respective connector passage;

wherein the rail center axis does not intersect with the injector center axes and does not intersect with respective port center axes of the ports in the body portions of the receiver cups;

wherein the rail center axis of the fuel rail is located relatively more laterally inboard with respect to the engine than is a center axis of at least one connector passage; and wherein the fuel rail is located between the intake runners and a nearest inner surface of a cowl covering the engine.

11. The fuel delivery system of claim 10, wherein outer surfaces of the closed ends of the body portions are relatively further laterally outboard with respect to the engine than are the port center axes of the ports in the body portions of the receiver cups.

12. The fuel delivery system of claim 10, wherein the injector center axis of each fuel injector is perpendicular to the respective port center axis of the port in the body portion of each receiver cup.

13. The fuel delivery system of claim 10, wherein each connector passage is integral with each respective receiver cup.

14. An outboard motor powerhead section comprising:

an internal combustion engine having a cylinder head coupled to a first end of a cylinder block, the cylinder block and the cylinder head together defining vertically stacked cylinders, and having intake passages, each intake passage extending through the cylinder head to a respective cylinder;

a crankcase cover coupled to a second, opposite end of the cylinder block;

intake runners that extend along a side of the cylinder block from the crankcase cover to the cylinder head, each intake runner providing intake air to a respective intake passage;

a fuel rail extending along a vertical center axis alongside the cylinder head;

receiver cups coupled to the fuel rail and vertically spaced from one another such that each receiver cup is associated with a respective cylinder, each receiver cup having a respective connector passage providing fluid communication between the fuel rail and the receiver cup;

fuel injectors respectively coupled to the receiver cups, each fuel injector having an inlet end located in a respective receiver cup and extending along a center axis toward a nozzle end that extends into a respective intake passage; and a cowl covering the engine;

wherein the vertical center axis of the fuel rail is located relatively more inboard with respect to the engine than is at least one connector passage;

wherein the fuel rail is located between the intake runners and an inner surface of the cowl;

wherein an outboard-most outer surface of the fuel rail is further from the inner surface of the cowl than are outboard-most outer ends of the receiver cups;

wherein each receiver cup comprises a tubular body portion having an open end for receiving the respective fuel injector and an opposite, closed end including a port communicating with the respective connector passage;

wherein the center axis of each fuel injector is oriented at an angle of less than 180 degrees with respect to a respective center axis of the port in the body portion of each receiver cup; and wherein the center axis of each fuel injector is horizontal and is perpendicular to the respective center axis of the port in the body portion of each receiver cup.

15. The powerhead section of claim 14, wherein the outboard-most outer end of each receiver cup is further outboard than the center axis of the port in the body portion of each receiver cup.

16. The powerhead section of claim 15, wherein a horizontal distance between the vertical center axis of the fuel rail and the outboard-most outer end of each receiver cup is between about 13 millimeters and about 16 millimeters.

* * * * *